United States Patent [19]

Marcon et al.

[11] Patent Number: 4,704,945

[45] Date of Patent: Nov. 10, 1987

[54] CONTROLLED PERCUSSION DEVICE FOR AUTOMATIC WEAPON

[75] Inventors: Joël M. Marcon; Jacques A. Durant, both of Bourges; Georges H. Simon, Saint-Germain du Puy, all of France

[73] Assignee: Etat Francais, Paris, France

[21] Appl. No.: 869,892

[22] Filed: Jun. 3, 1986

[30] Foreign Application Priority Data

Jun. 7, 1985 [FR] France ..... 85 08601

[51] Int. Cl.[4] ..... F41D 11/04

[52] U.S. Cl. ..... 89/185

[58] Field of Search ..... 89/164, 166, 172, 181, 89/185

[56] References Cited

U.S. PATENT DOCUMENTS 884,065 4/1908 Bräuning ..... 89/172

4,154,143 5/1979 Pechamat et al. ..... 89/11

*Primary Examiner*—Stephen C. Bentley

*Attorney, Agent, or Firm*—Parkhurst & Oliff

[57] ABSTRACT

The field of the invention is that of percussion devices used in automatic weapons.

The invention consists of integrating the firing pin 12 with carrier piece 1 during the locking phase and then with the movable bolt head 7 during the recoil phase. The integration means consists of levers 17 pivoting on the firing pin about shaft 18 and bearing on surfaces 23 and 26 on the movable bolt head and counterpin 14, respectively.

The invention finds its applications in the field of weaponry and, more particularly, in small- and medium-caliber weapons.

11 Claims, 4 Drawing Figures

SECTION AA

SECTION AA

CONTROLLED PERCUSSION DEVICE FOR AUTOMATIC WEAPON

BACKGROUND OF THE INVENTION

1. Field of the Invention

The present invention relates to a percussion device for an automatic weapon with a barrel of the type powered by an internal energy source (such as of the gas operated type), or with an external energy source.

2. Description of the Prior Art

In the current state of the art, there are three types of percussion devices:

spring-driven mechanisms such as those used in Gatling type weapons, consisting of a firing pin sliding in the breech block and driven by a spring tht is compressed as the breech moves forward in the weapon, held in position by a stop and then released by retracting the stop after locking the breech on the weapon barrel.

The main disadvantage of these mechanisms is that the firing pin speed, and thus the percussion energy, depend on the stiffness of the spring, which may vary during the lifetime of the weapon. Also, since the firing pin is not secured to the breech after the percussion and during the recoil absorption phase, the firing pin may be thrown violently to the rear due to the large pressures developed on the percussion cap during the combustion of the propulsive charge.

Inertial mechanisms consist of a firing pin of set mass sliding in the breech block, driven by the forces of inertia. When the breech impacts with and locks on the weapon barrel, the firing pin is projected toward the ammunition and initiates it.

This type of device presents disadvantages similar to those of the previously described mechanism, since the friction of the firing pin in the breech block (due to surface condition, insufficient lubrication, and dirtying) may change the percussion energy. The firing pin is not integral with the breech block during the locking and percussion phases of operation.

OBJECT OF THE INVENTION

The main object of this invention is to offer a percussion device that remedies the disadvantages of devices constructed according to the current state of the art. To do this, the invention integrates the firing pin with the carrier piece during the locking phase and then with the movable bolt head during the recoil phase.

SUMMARY OF THE INVENTION

Accordingly, the device offers a very high level of safety, because the percussion is controlled, i.e., it is performed at a very precise time that is determined by the design of the mechanism.

Another advantage stems from the fact that the percussion energy is very high because the full inertia of all the parts in motion contribute to the initiation since the firing pins is linked to the carrier piece.

In accordance with another feature of the invention, the percussion device is completely passive when the breech block is in its rear position because there is no stored energy. This is not always the case for known devices using springs, which can jeopardize safety if the spring retainer stop breaks.

The percussion device for automatic weapons with a barrel includes: one carrier piece moving back and forth parallel to the barrel centerline, one movable bolt head that presses against the barrel, carried by and sliding on the carrier piece in the first "locking" course of travel integrating the moving head on the barrel, and at the end of which course the percussion takes place, then a second "recoil" course of travel, and one firing pin sliding in the movable bolt head.

In accordance with an initial feature of the invention, it includes a first means of linking the firing pin with the carrier piece during the locking course of travel and a second means of linking the firing pin to the movable bolt head during the recoil course of travel, with these means operating consecutively.

In accordance with other particular features:

it includes a counterpin integral with the carrier piece that can slide with respect to the firing pin and which cooperates with the said linking means;

the course of travel of the counterpin with respect to the firing pin is roughly equal to the recoil-absorbing course of travel;

the first linking means consists of at least one lever pivoting on the firing pin about an axis perpendicular to the barrel axis, having a surface bearing on a corresponding inner surface on the movable bolt head, cooperating with a shoulder on the counterpin and retracting into a recess in the movable bolt head to release the link;

the second linking means consists of at least one lever pivoting on the firing pin about an axis perpendicular to the gun barrel axis, having a surface bearing on a corresponding outer surface on the counterpin, cooperating with a notch in the inner surface of the movable bolt head and retracting into a recess in the counterpin to release the link;

the step in the counterpin has a recess allowing for the penetration of the lever into the counterpin shoulder;

the recess in the movable bolt head is used as a notch for locking the firing pin with the movable bolt head;

the recess in the counterpin is used as a shoulder for locking the firing pin with the counterpin;

the lever is used for the first and second means of linking .

BRIEF DESCRIPTION OF THE DRAWING

Further advantages and features of this invention will be apparent from the following detailed description of several embodiments of this invention with reference to the accompanying drawings in which.

DESCRIPTION OF THE PREFERRED EMBODIMENTS

Figure 1:
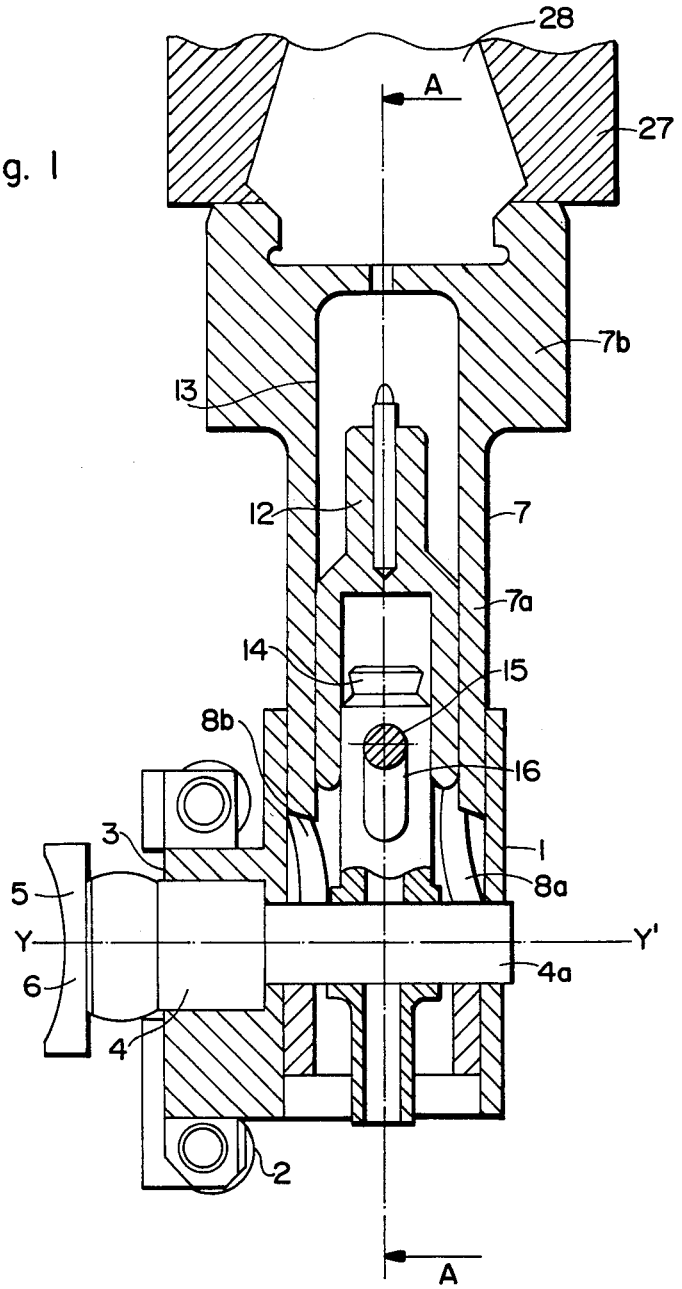
FIG. 1 is a longitudinal section of a percussion mechanism according to the invention with the firing pin retracted.
Figure 2:
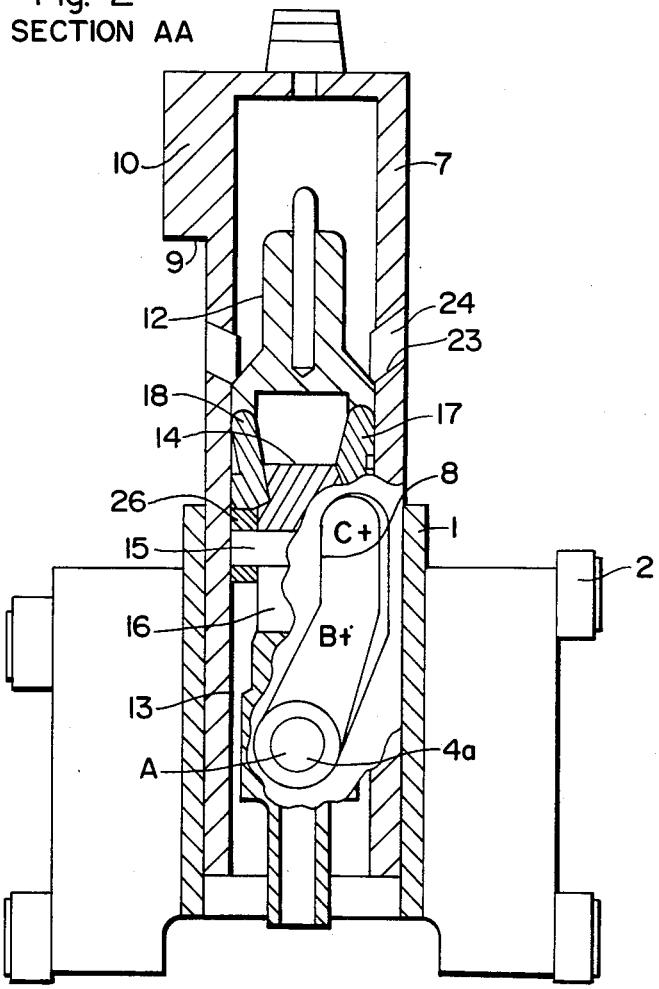
FIG. 2 is a partially broken away sectional view along line A—A in FIG. 1.

FIG. 1 illustrates a percussion device including one carrier piece 1 consisting of a tubular part with centerline X—X' aligned with the centerline of the weapon barrel 27 and munition 28, placed on top of a prismatic sections on which four guide rollers 2 are fastened on a prismatic part, bearing on a small beam that is not illustrated but which is integral with the frame and the barrel of the weapon. This carrier piece 1 features a bore 3 perpendicular to the line X—X' in which shaft 4 is fitted, carrying one roller 5 and one shoe 6 sliding in the groove of a rotating drum, not illustrated, thus moving the assembly in alternating back-and-forth motion so that the ammunition can be loaded in the weapon barrel. Shaft 4 extends by cylindrical part 4*a* through the tubular part of the carrier piece 1. The movable bolt head 7 consists of a tubular part 7*a* sliding in the tubular part of the carrier piece 1 and of bridge 7*b* bearing on the barrel of the weapon, not illustrated, to close the propulsion chamber when the ammunition is introduced. This movable bolt head 7 also includes two diametrically opposed ramps 8*a* and 8*b* going through the cylindrical part 4*a* of shaft 4. This ramp consists of one helical part 8*a–b* (FIG. 2) and one straight part B–C. The helical part 8*a–b* is used to lock the movable bolt head to the weapon barrel. In effect, in operation, the carrier piece advances towards the weapon barrel, the movable bolt head 7 butts up against the barrel, then the shaft 4 riding along ramp A–B pivots the head, which locks at the rear surface 9 of notches 10 on an additional form of the weapon barrel.

The straight part B–C of the ramp is a shock-absorbing course used in this particular example, in the case of a slow-firing or missed shot. In effect, the rotating drum guiding the alternate motion of the mobile assembly (mobile head 7, actuator 1 and related components) is driven by an external energy motor of the electric type. With this type of weapon, the initiation success/miss information is not necessarily provided to the automatic system logic, contrary to what happens in a conventional weapon driven by an internal source of the gas operated type, for example. Consequently, a slow-firing piece of ammunition may be extracted and ejected from the firing chamber before it fires, and then afterwards burn in a part of the weapon or mount that is poorly protected or not protected at all, thus jeopardizing the safety of the operator.

Figure 3:
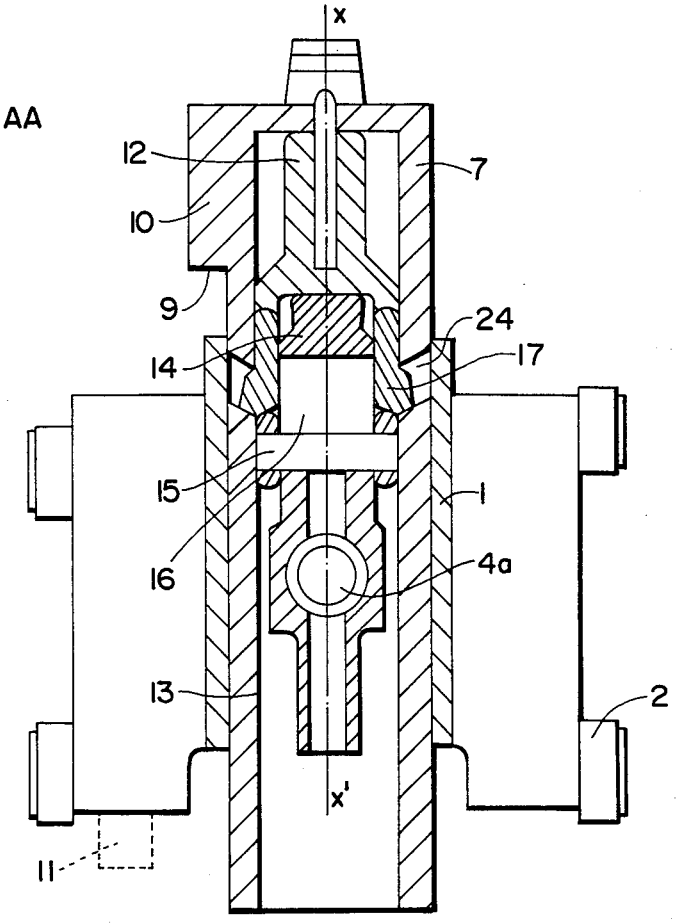
FIG. 3 is a sectional view along line A—A in FIG. 1 after percussion.

For this problem it is planned to fit this type of weapon with a "slow-initiation safety" device such as the one described in French Pat. No. 76 35 639 and corresponding U.S. Pat. No. 4,154,143. This device includes systems sensitive to the "shot initiated" information generated by transducers determining the longitudinal position of the weapon with respect to the cradle supporting it. In case of slow initiation, the weapon is not driven backward and the transducers transmit the order to block the moving system so as to keep the weapon firing chamber from opening. The blocking means consist of latches 11 (diagramed in FIG. 3) bearing on the back of carrier piece 1. These latches are mounted elastically with respect to the weapon frame so as to damp the recoil of the moving assembly until it stops completely, the energy absorbed by the electric link then being equal to the kinetic energy of the entire weapon mechanism.

The recoil course of travel results from the fact that roller 5 continues to ride along the drum ramp after movable bolt head 7 is then latched on the weapon barrel. Thus a relative travel B–C between the movable bolt head 7 and the carrier piece 1 must then be provided for.

It should be noted that this type of percussion device can be used with a classical weapon driven by an internal energy source, with the course of travel A–B serving to lock the movable bolt head on the weapon barrel and the course B–C being used to damp the end of travel of the moving assembly.

The device according to the invention also includes a firing pin 12 sliding along a reaming 13 in movable bolt head 7, in which a counterpin 14 can move that is linked to the carrier piece 1 by shaft 4. The firing pin and counterpin are held by one pin 15 whose extremities are linked to the firing pin and which slides in an oblong groove in the counterpin 14.

Figure 4:
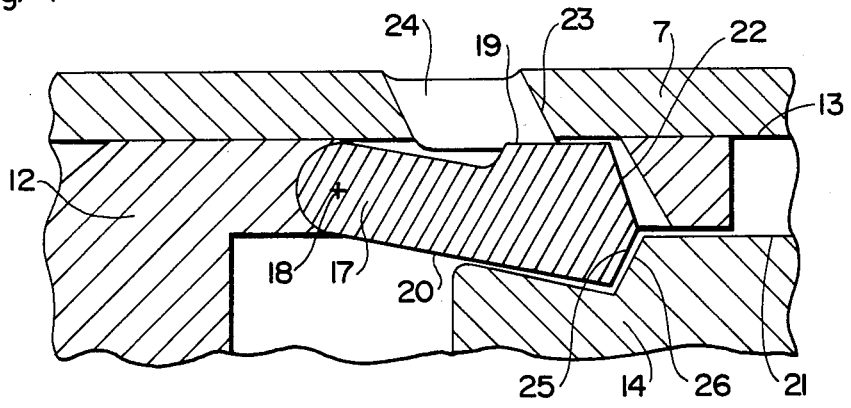
FIG. 4 is a detailed view of the locking device.

The device (FIG. 4) linking the movable bolt head 7 with the firing pin 12 and the firing pin with the counterpin 14 includes two levers 17 pivoting on the firing pin about shaft 18, perpendicular to the X—X' line. The levers include one cylindrical surface 19 that can slide inside the surface 13 of the movable bolt head when the said levers are retracted, and a second surface 20 that can slide on the lateral surface 21 of the counterpin when the levers link the firing pin with the movable bolt head 7. A flat 22 is provided at the end of the levers to block the firing pin-moving head by bearing on the surface 23 of a notch 24 in the movable bolt head. In the same way, a second flat 25 cooperates with a shoulder 26 on the counterpin 14 to link the firing pin with the counterpin. It should be noted that all of the surfaces 22, 23, 25 and 26 are inclined with respect to X—X' line in such a way as to facilitate the movement of the levers.

The device operates as follows: roller 5 rides in the slot in the rotating drum to insert ammunition in the weapon chamber. The front face of the movable bolt head comes up against the rear end of the weapon barrel and locks it by ramps 8*a* and 8*b*. During this locking course of travel A–B, the firing pin 12 is linked to the counterpin 14 by levers 17 (FIG. 2) and advances at the same speed as the control part 1.

At the end of the locking course, the percussion of the ammunition takes place, the levers 17 turn over to link the firing pin 12 with the movable bolt head while the firing pin is separated from the counterpin (FIG. 3), the movable bolt head continues its relative motion (course of travel B—C) with respect to carrier piece 1.

As the device returns toward the rear of the weapon, the same events occur in reverse order.

It is thus seen that the firing pin is always integral with another piece, which offers a high level of safety in use as compared with other percussion devices according to the state of the technique.

Also, the percussion takes place at a position that is very precisely determined when the weapon is designed and which never varies throughout the entire lifetime of the weapon, contrary to spring-driven devices that tend to lose their characteristic after a great many operations.

What we claim is:

1. A percussion device for an automatic weapon with a barrel comprising: a carrier piece moving alternately in opposite directions parallel to the barrel centerline; a movable bolt head adapted to come up against the barrel, carried by the carrier piece and slidable translationally with respect to the carrier piece along a first course of travel during which the movable bolt head is locked on the barrel and at the end of which a percussion takes place, then a second course of travel during which recoil shock is absorbed; and a firing pin slidable in the movable bolt head, the percussion device further comprising linking means for creating a first link wherein the firing pin is fixedly linked to the carrier piece during the first course of travel and for creating a second link wherein the firing pin is fixedly linked to the movable bolt head during the second course of travel, said linking means operable to create said first and second links consecutively.

2. The percussion device claimed in claim 1, wherein said linking means includes a counterpin attached to the carrier piece that can slide with respect to the firing pin.

3. The percussion device claimed in claim 2, wherein the travel of the counterpin with respect to the firing pin is roughly equal to the second course of travel.

4. The percussion device claimed in claim 2, wherein the linking means further comprises at least one lever pivoting on the firing pin about an axis perpendicular to the barrel axis, having a first surface that bears against a corresponding inner surface on the movable bolt head, said first surface and said inner surface cooperating with a shoulder in the counterpin to create said first link, said lever being retractable into a recess in the inner surface of the movable bolt head to break the first link.

5. The percussion device as claimed in claim 4, wherein said at least one lever has a second surface that bears against a corresponding outer surface of the counterpin, said second surface and said outer surface cooperating with the recess in the inner surface of the movable bolt head to create the second link and said lever being retractable into the shoulder of the counterpin to break the second link.

6. The percussion device as claimed in claim 5, wherein the shoulder of the counterpin is adapted to assist in penetration of the lever into the recess on the inner surface of the movable bolt head.

7. The percussion device as claimed in claim 6, wherein the recess on the inner surface of the movable bolt head is adapted to assist in penetration of the lever into the shoulder of the counterpin.

8. The percussion device as claimed in claim 7, wherein the recess in the movable bolt head is adapted to lock the firing pin with the movable bolt head.

9. The percussion device as claimed in claim 8, wherein the shoulder of the counterpin is adapted to lock the firing pin with the counterpin.

10. The percussion device claimed in claim 1, wherein said first course of travel and said second course of travel are in the same direction.

11. The percussion device claimed in claim 1, wherein said first and second links are created exclusive of one another.

* * * * *